United States Patent [19]

Colglazier et al.

[11] 4,175,741

[45] Nov. 27, 1979

[54] CUT-SHEET XEROGRAPHIC COPIER HAVING COMBING WHEEL SHEET FEED AND A DUPLEX BIN WITH AN ADJUSTABLE BOTTOM-OF-THE-BIN PAD

[75] Inventors: Donald F. Colglazier; John L. Fallon; George P. Kimble, all of Longmont; Fred R. Mares, Boulder, all of Colo.

[73] Assignee: International Business Machines Corporation, Armonk, N.Y.

[21] Appl. No.: 861,914

[22] Filed: Dec. 19, 1977

[51] Int. Cl.[2] ..... B65H 3/06

[52] U.S. Cl. ..... 271/3.1; 271/113; 271/119; 271/124

[58] Field of Search ..... 271/3.1, 113, 119, 120, 271/121, 124

[56] References Cited

U.S. PATENT DOCUMENTS

| | | | |
|---|---|---|---|
| 990,256 | 4/1911 | Gustafson | 271/120 |
| 1,109,902 | 9/1914 | Cross | 271/111 |
| 2,195,576 | 4/1940 | Metzger | 271/124 |
| 3,645,615 | 2/1972 | Spear | 355/3 R |
| 3,900,192 | 8/1975 | Gibson | 271/3.1 |
| 3,966,190 | 6/1976 | Grant | 271/42 |

FOREIGN PATENT DOCUMENTS

| | | | |
|---|---|---|---|
| 1427357 | 3/1976 | United Kingdom | 271/120 |

*Primary Examiner*—Richard A. Schacher
*Attorney, Agent, or Firm*—Francis A. Sirr

[57] ABSTRACT

A multibin, cut-sheet xerographic copier capable of operating in a simplex or a duplex copy mode, wherein sheets are fed from a selected sheet stack, one at a time, to the copier's transfer station, by a sheet feeding means which includes a combing wheel.

The combing wheel shingles the leading edge of the stack's top sheet to an open feed roller nip, to be sensed there by a pneumatic sensor. Sensing of this leading edge causes the combing wheel to be lifted off the stack. Subsequently, at a time determined by the copier's control logic, the drive nip closes to thereby feed the top sheet to the copier's paper registration gate, and then to its transfer station. As soon as this sheet's trailing edge has cleared the pneumatic sensor, and the drive nip has opened, the next sheet is staged at the shingled position, in the open drive nip.

Side-one copied sheets, of intended duplex copies, are automatically stacked in a duplex bin. The bottom of the duplex bin includes a flat, resilient bottom-of-the-bin pad. This pad's position is adjustable in a plane parallel to the bottom of the duplex bin, to facilitate control of the direction in which side-one copied sheets are fed out to the copier's paper registration gate, for side-two copying.

9 Claims, 14 Drawing Figures

FIG. 5
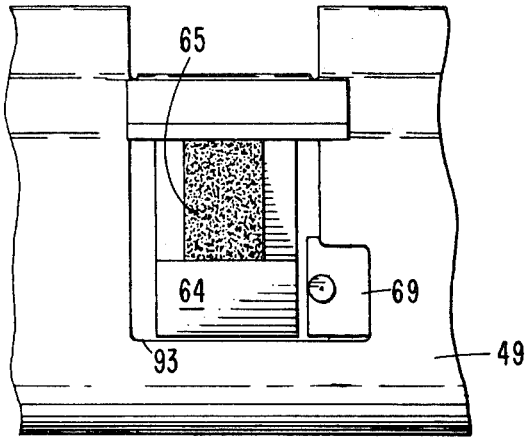
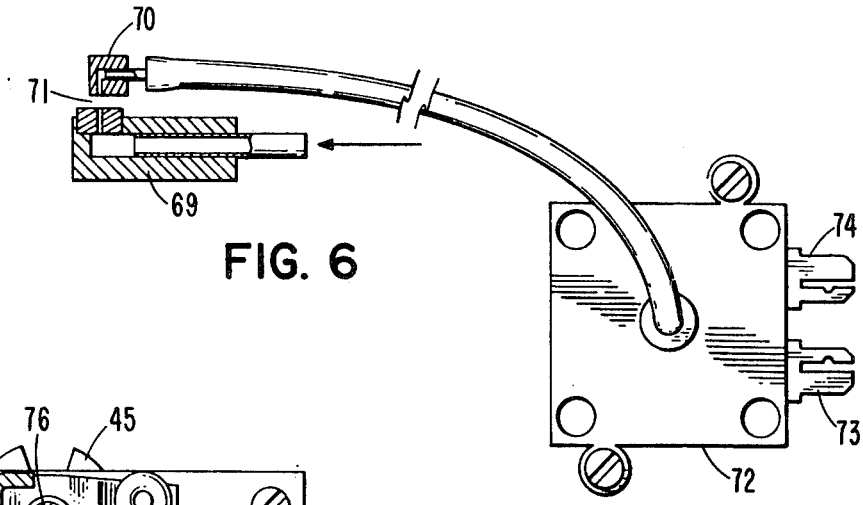
FIG. 6
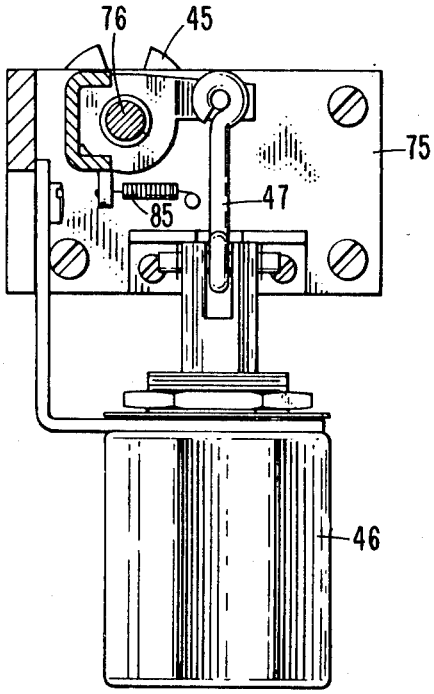
FIG. 7

CUT-SHEET XEROGRAPHIC COPIER HAVING COMBING WHEEL SHEET FEED AND A DUPLEX BIN WITH AN ADJUSTABLE BOTTOM-OF-THE-BIN PAD

CROSS-REFERENCE TO RELATED APPLICATIONS

Copending application Ser. No. 788,574, now U.S. Pat. No. 4,126,305, filed Apr. 18, 1977, in the name of Donald F. Colglazier, et al, and commonly assigned, discloses and claims a combing wheel of a unique resilient construction usable with the present invention.

Copending application Ser. No. 788,471, now U.S. Pat. No. 4,089,516, filed Apr. 18, 1977, in the name of Donald F. Colglazier, et al, and commonly assigned, discloses and claims a simplex/duplex xerographic copier having combing wheel sheet feed, wherein the duplex bin is of a construction and arrangement usable with the present invention.

Copending application Ser. No. 788,570, now U.S. Pat. No. 4,113,245, filed Apr. 18, 1977, in the name of Donald F. Colglazier, et al, and commonly assigned, discloses and claims a closable feed nip having special utility when used with a combing wheel sheet feeder.

BACKGROUND AND SUMMARY OF THE INVENTION

The use of a variety of feed means, including friction feed means, to feed cut sheets to the transfer station of a printer in the form of a xerographic copier is of course well known.

The use of combing wheel feed means to feed cut sheets to a printer is also wheel known.

The use of combing wheel feed means, to feed cut sheets to the transfer station of a xerographic copier, is suggested by the prior art.

The use of a free-moving belt in the bottom of a bin, and cooperating with an oscillating friction feeder, for feeding cards is also known.

With the foregoing in mind, the present invention relates to a combing wheel sheet feeder wherein the combing wheel cooperates with a movable, or a resilient means or pad located in the plane of a sheet support platform. Movement of this pad in the direction of sheet shingling simulates sheets located below the actual bottom sheet. The relative position of the combing wheel's area of sheet contact, and the position of this pad, is adjustable generally in the plane of the support platform. This relative positioning allows the shingling direction to be controlled.

A particular utility resides in the duplex bin of an automatic duplexing xerographic copier. In this device it is desirable to skew or rotate side-one copied sheets slightly as they are fed out of the duplex bin for side-two copying. Adjustment of the above-mentioned pad facilitates control of this skew for the last approximately ten sheets.

The last sheet experiences skew-producing forces from the tray which are different from the skew-producing forces experienced by sheets higher in the stack. This pad is adjusted to compensate for this difference. The pad comes into play only when the stack of sheets is approximately ten or fewer, so that the bottom sheet begins to move as its above sheets are being shingled.

The term combing wheel, as used herein, is intended to encompass not only the vertical orientation shown (i.e. the plane of combing wheel rotation is perpendicular to the flat surface of the sheets being fed), but is also intended to encompass a tilted orientation (i.e. the plane of rotation being between vertical and horizontal). Also, while a circular wheel is preferred, its equivalent may be to support rollers or the like on a flexible belt or chain which does not travel a closed circular course. In addition, while the combing wheel's sheet engaging surface is shown in its preferred form as a hard, friction-free roller, it is within the scope of the present invention to utilize a resilient roller, or a roller having friction, or a nonrotating sheet engaging surface, or combinations thereof.

INCORPORATION BY REFERENCE

The copier apparatus schematically shown in FIG. 1 is the IBM Series III Copier/Duplicator, and its Service Manual Form Number 241-5928-0, March 1976, are incorporated herein by reference for purposes of indicating the background of the invention and illustrating the state of the art.

The foregoing and other features and advantages of the invention will be apparent from the following more particular description of a preferred embodiment of the invention, as illustrated in the accompanying drawing.

BRIEF DESCRIPTION OF THE DRAWING

FIG. 5 is a top view of FIG. 4's feed nip lower pad assembly, showing the lower portion of the pneumatic sensor which senses the leading edge portion of a sheet which is staged into the normally open sheet drive nip;

FIG. 6 is a side view of the pneumatic sensor, partly in section;

FIG. 7 is a view of the solenoid whose energizing lowers the duplex tray's combing wheel down onto the paper in the duplex tray;

DESCRIPTION OF THE PREFERRED EMBODIMENT

Figure 1:
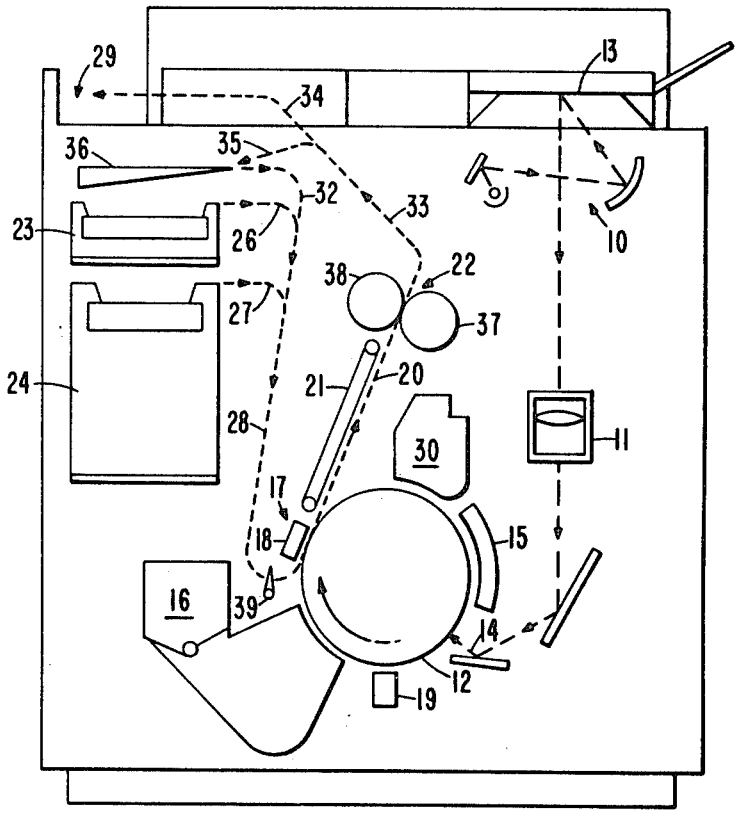
FIG. 1 is a schematic front view of a simplex/duplex mode electrophotographic copier incorporating the present invention.

FIG. 1 is a schematic view of a simplex/duplex mode xerographic copier incorporating the present invention, for example the IBM Series III Copier/Duplicator. In this device a scanning mirror system 10 and a moving lens 11 move in synchronism with the rotation of photoconductor drum 12 to place a latent image of stationary original document 13 on the drum's surface. Drum 12 is constructed and arranged with two operative photoconductor panels on its circumference, so as to be capable of producing two copies for each drum revolution.

As is well known, prior to imaging at 14, the drum is charged by corona 15. Since only the photoconductor's working area, i.e. the area which will correspond to a sheet of copy paper at transfer station 17, need be charged, the photoconductor surrounding this working area is erased by erase station 19, for example by means described in the IBM TECHNICAL DISCLOSURE BULLETIN of November 1976, at pages 1983 and 1984.

After imaging, the drum's latent image is developed by magnetic brush developer 16. Thereafter the drum's toned, visible image is transferred to a sheet of plain copy paper at transfer station 17 by operation of transfer corona 18. A Bernoulli sheet detach means, as shown in the IBM TECHNICAL DISCLOSURE BULLETIN of January 1973 and May 1973, at pages 2378 and 365, respectively, operates to cause the now-toned sheet to leave the surface of the drum and to follow sheet movement path 20, adjacent vacuum conveyor 21, on its way to hot roll fuser assembly 22. As the sheet moves through path 20, the sheet's straight leading edge is perpendicular to path 20. After fusing, the finished copy sheet follows sheet path 33, 34 and is deposited in output tray 29 when the copier is operating in the simplex mode, or side two in the duplex mode. When the copier is operating in the duplex mode, side one, the side-one copier sheet follows sheet path 33, 35, and is deposited in duplex bin 36. Thereafter, when operating in the side-two duplex mode, these sheets return to the transfer station while following sheet path 32, 28.

After transfer, the drum is cleaned as it passes cleaning station 30.

The copier of FIG. 1 includes two copy sheet supply bins 23 and 24. Each supply bin includes a bidirectionally vertically movable elevator which supports the stack. While this structure is well known to those of skill in the art, an exemplary structure is described in the IBM TECHNICAL DISCLOSURE BULLETIN of August 1974, at pages 670 and 671. Feed means of the type described in the above-mentioned copending application Ser. No. 788,471, within the bin selected for use, is operable to feed the boundary sheet, i.e. the top sheet, of the stack to its sheet discharge path 26, 27, 32. This sheet is rear-edge-aligned as it travels down sheet path 28 to be momentarily stopped at paper registration gate 31. As the leading edge of the drum's toned image arrives in the vicinity of this gate, the gate is opened to allow the sheet to move into transfer station 17 with its leading edge in exact registry with the drum's image leading edge.

Figure 8:
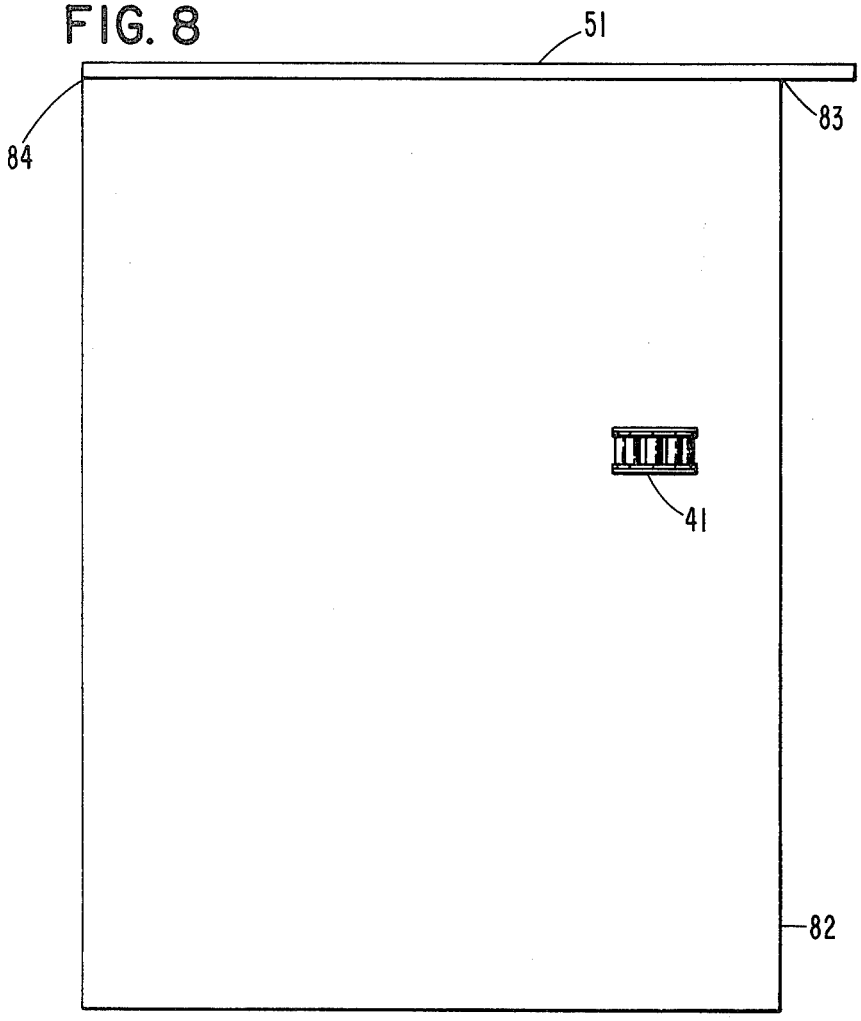
FIG. 8 is a top view of a letter size sheet of paper in FIG. 2's duplex tray, showing the placement position of the combing wheel, and the relationship of the duplex bin's ribbed rear vertical wall.

This rear-edge-alignment as defined by the rear edge of the various bins, for example, the rear edge 51 of FIG. 8's duplex bin.

The construction of hot roll fuser assembly 22 will not be described in detail. Generally, hot roll 37 is heated to an accurately controlled temperature by an internal heater and and associated temperature control system, not shown. The hot roll preferably includes a deformable external surface formed as an elastomeric surface. This surface is designed to engage the toned side of the copy sheet, fuse the toner thereon, and readily release the sheet with a minimum adherence of residual toner to the hot roll. Such a hot roll is described, for example, in the IBM TECHNICAL DISCLOSURE BULLETIN of August 1973, at page 896.

Backup roll 38 is preferably a relatively cool and rigid roll. Rolls 37 and 38 are circular cylinders, such that the fusing nip formed thereby defines a line (of some width due to deformation of hot roll 37) parallel to the axis of rolls 37 and 38.

The fusing nip formed by rolls 37 and 38 may be closed and opened in synchronism with the arrival and departure of the copy sheet's leading and trailing edges, respectively. This synchronism is achieved by a drum position sensing means, not shown, which responds to the position of drum 12 and effects opening and closing of the nip by means of a copier logic control system, not shown. An exemplary mechanism for effecting the opening and closing of this nip is shown in the IBM TECHNICAL DISCLOSURE BULLETIN of May 1973, at page 3644. In the alternative, for a multicopy run, the fusing nip may remain continuously closed until the trailing end of the last sheet has passed therethrough.

The term copier control logic is intended to encompass the various means known to those of skill in the art. Generally known forms involve electronic processors, hard-wired logic circuits, electromechanical relays, and/or cam controlled switches or their equivalent. As is well known, the drum's changing position generates position signals which are then related to means such as a comparison of the number of copies requested to the number of times the original document has been scanned. So long as more copies are needed, latent images are formed on the photoconductor, and one sheet of paper is fed to the transfer station for each image.

Sheet supply bins 23 and 24 are constructed and arranged to adjustably hold cut sheets of transfer material of different sizes, for example legal and letter size paper, respectively. Sheets therein are oriented such that their narrow dimension is in the direction of paper feed 28. In addition, the sheets in each bin are stacked such that their rear narrow edge (which is parallel to the direction of paper feed 28) lies in a common vertical plane, i.e. rear-edge-alignment. Thus, if bin 23 contains legal size paper, its front narrow edge overlaps the front narrow edge of letter size paper in bin 24 by some three inches. As a sheet travels down sheet path 28 its long leading edge is presented to gate 28 and transfer station 17 such that this edge is substantially parallel to the axis of photoconductor drum 12.

The sheet feeding means operable to feed cut sheets out of bins 23, 24 and 36 is of the combing wheel type described in the three above-mentioned copending applications.

The present invention is concerned with an adjustable bottom-of-the-bin pad usable with a combing wheel sheet feeder, for example of the type provided for bins 23 and 24, and having special utility when used in duplex bin 36.

A significant difference between bins 23 and 24 and duplex bin 36 is that the paper stack resident in bins 23 and 24 comprises a virgin stack having orderly, well defined side edges. Thus feed-out is predictable. In the duplex bin, however, sheets are serially fed, one at a time, into the bin by way of path 35. While bin 36 is constructed and arranged to provide orderly stacking, this stacking is subject to variations caused by electrostatics, humidity and the like. Thus, it has been found that a slight clockwise skewing of a sheet during feed-out (as viewed from above) is desirable in order to provide more reliable sheet feed into and through path 32, 28. More specifically, and with reference to FIG. 8, this skewing is such that the sheet's rear edge, leading corner, 83 is moved away from the bin's rear edge 51. As a result, the sheet's edge 83–84 is less likely to catch or jam as it travels FIG. 1's path 32, 28. The sheet is properly rear-edge-aligned as it traverses path 28.

The present invention allows this skew to be adjusted by way of the present invention's adjustable bottom-of-the-bin pad.

The present invention will be described as it relates to duplex bin 36. However, it is usable with bins 23 and 24, or with combing wheel sheet feeders generally.

Figure 2:
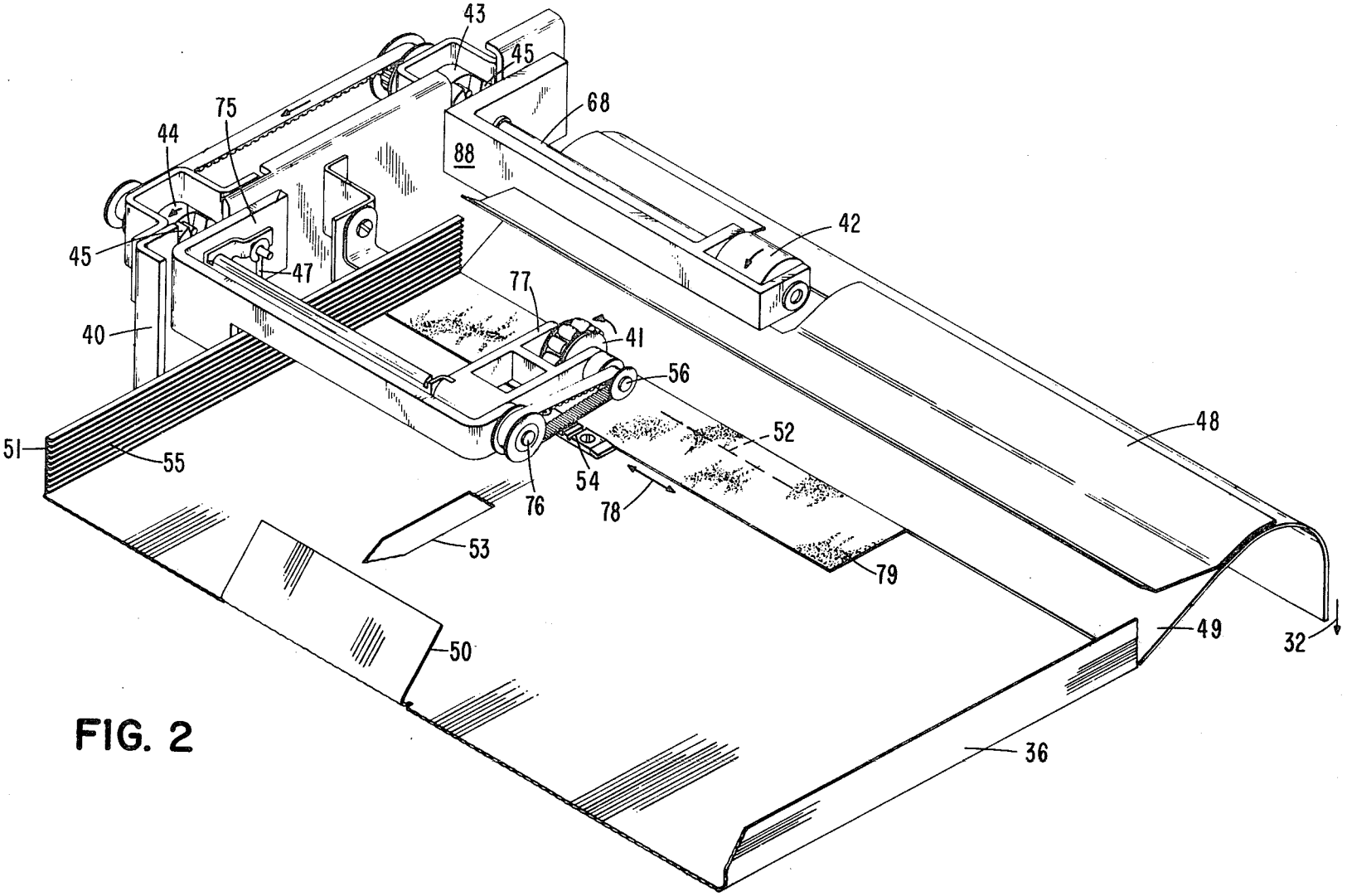
FIG. 2 is a partial front view of FIG. 1's copier frame and the duplex tray attached thereto, and showing the duplex tray's combing wheel, bottom-of-the-bin pad, and closable drive nip with its cooperating sheet guides.

FIG. 2 is a partial front view of the copier frame 40 of FIG. 1's copier, showing FIG. 1's duplex tray 36 attached thereto. Arrow 32 relates the sheet's exit path from the duplex tray to path 32 shown in FIG. 1.

Combing wheel 41 and drive roller 42 are each provided with its own drive coupling 43, 44 cooperating with its mating drive coupling 45. Thus, continuous counterclockwise rotation of combing wheel 41 and drive roller 42 is achieved. The means for driving couplings 43 and 44 is shown and described in greater detail in the above-mentioned copending applications.

Combing wheel 41 is spring biased to an elevated position, away from bottom-of-the-bin pad 54, and is moved down onto the top sheet of the stack of sheets within duplex bin 36 by energization of a solenoid 46 (see FIG. 7) connected to link 47. Drive roller 42 is mounted at a fixed position, such that its lower surface penetrates the sheet guide channel formed by upper sheet guide 48 and lower sheet guide 49.

The construction of the duplex bin's combing wheel and drive roller assemblies is necessitated by virtue of FIG. 1's sheet path 35. As is well known, FIG. 1's alternate sheet paths 34 and 35 are implemented by a pivoting exit vane, not shown. When this exit vane is in a down position, side-one copied sheets of a duplex copy run are inserted into FIG. 2's duplex tray 36, as the leading edge of these sheets pass over the top of roller 42 (by virtue of sheet guides not shown), and down below combing wheel 41, coming to rest with the sheet's leading edge adjacent the duplex tray's inclined stop member 50. In this position, the sheet's rear edge is in the general vicinity of the duplex bin's rear wall 51, and its trailing edge (this will be the leading edge when paper exits the duplex tray on its way to side-two copying) resides as generally shown by broken line 52 of FIG. 2.

The duplex bin's combing wheel assembly (including plate 75, shaft 76, and pivotable support member 77), is removable as a unitary assembly, and its drive roller assembly, including sheet guides 48 and 49, are removable as a unitary assembly.

Duplex bin 36 is of the type disclosed in the above-mentioned service manual, and includes, among other things, an opening 53 which is adapted to cooperate with a sensor indicating the presence or absence of paper in the duplex bin. The duplex bin of the present application differs from that described in the above-mentioned service manual in two material aspects. Namely, an adjustable bottom-of-the-bin pad 54 cooperates with combing wheel 41, and the rear surface of the duplex bin includes a corrugated-like structure 51 having projecting ribs 55. As will be apparent, pad 54 is manually adjustable in the direction represented by arrow 78 so as to control its position under combing wheel 41, and thereby control the sheet skew or rotation which occurs during sheet feed-out, i.e. as the sheet's leading edge is presented to the open drive nip including drive roller 42.

Figure 3:
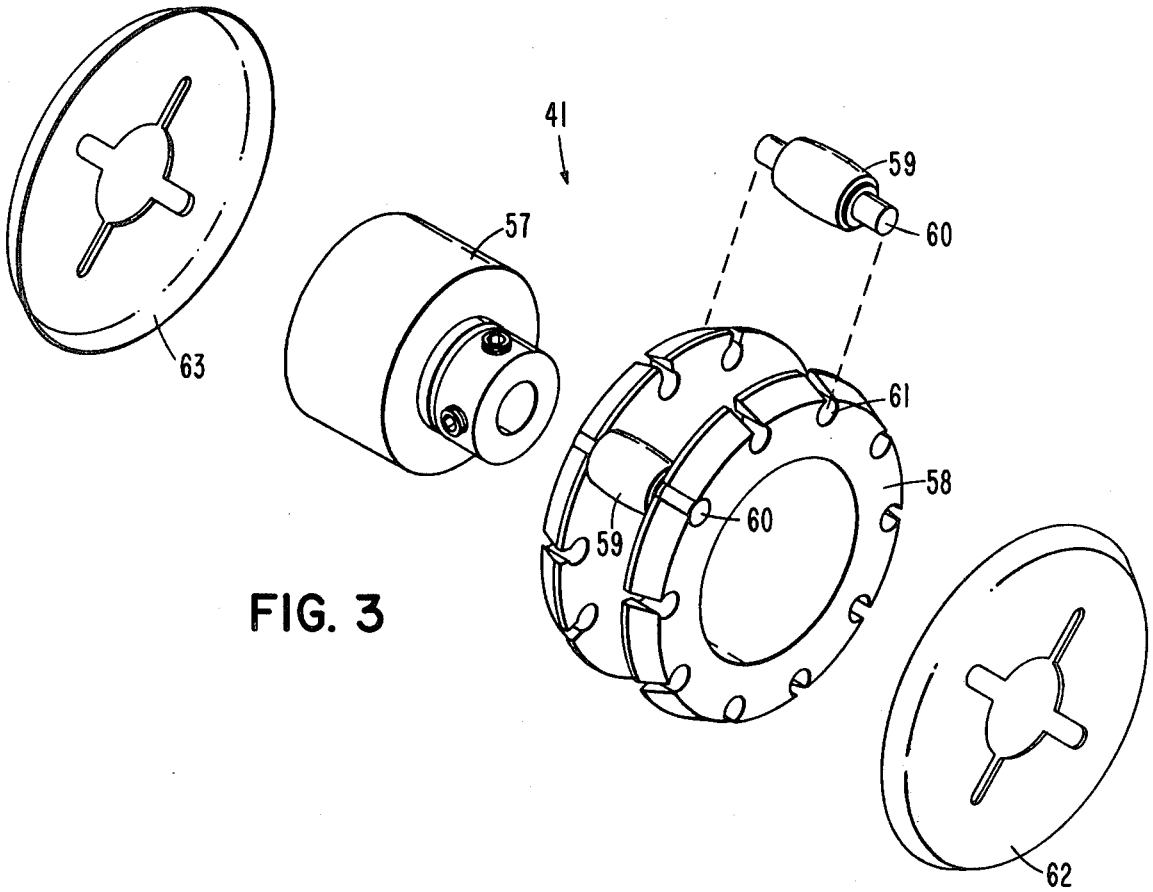
FIG. 3 is an exploded view showing the resilient construction of FIG. 2's combing wheel.

Combing wheel 41 is constructed and arranged such that its sheet engaging rollers are supported by a resilient member. With this construction, acoustical noise in a convenience copier environment, such as a business office, is minimized, repeatable, reliable shingling is enhanced, and marking or polishing of the paper is minimized. With reference to FIG. 3, combing wheel 41 is supported on its shaft 56 by way of a rigid, metallic hub 57. This hub securely fits within a generally doughnut shaped rubber wheel 58 having an annular cavity containing a plurality of sheet engaging rollers 59. Rubber wheel 58 is of a durometer in the range of 40 to 80. Too low a durometer may cause the wheel's flanges, rather than its rollers, to hit the paper. Too high a durometer increases both the acoustical noise and the force variations with which the rollers strike the paper. These rollers are constructed of a hard, low friction material, such as metal or plastic, and are rotationally and substantially frictionless supported on a metal shaft 60. The opposite ends of each shaft 60 are pressed into radially extending positioning slots 61 formed about the two spaced, resilient walls defining the annular cavity occupied by symmetrically crowned rollers 59. Once all rollers are assembled on member 58, the assembly is completed by a pair of metal end caps 62 and 63. These end caps do not physically engage axles 60, but allow radial movement of each axle with respect to the combing wheel shaft 56, such that the combing wheel exhibits a resilient construction. Each end cap includes an annular inturned rib which overhangs the ends of axles 60, thus imprisoning the axles. This construction and arrangement allows each of the rollers 59 to conform to the planar top surface of the paper, rather than rebounding off the paper and then settling back down onto the paper, in rapid oscillatory fashion. The lack of such vibration operates to reduce acoustical noise and improves the shingling phenomenon. Pins 60 are effectively isolated from hub 57 by the use of resilient rubber-like member 58. This rubber material exhibits a spring rate and damping factor, and deforms under load allowing each roller to remain in contact with the top sheet of paper for a longer period of time than would occur in a nonresilient construction. In addition the force magnitude excursions are minimized. The resilient rubber-like material of member 58 serves as a spring-damper and dampens the wheel's force function, allowing the roller to remain in contact with the paper, rather than rebounding and settling down on the paper in an oscillatory fashion. The forming of slots 61 in member 58 facilitates ease of assembly, either manual or machine assembly.

This combing wheel construction is more particularly described in above-mentioned copending application Ser. No. 788,574.

Figure 4:
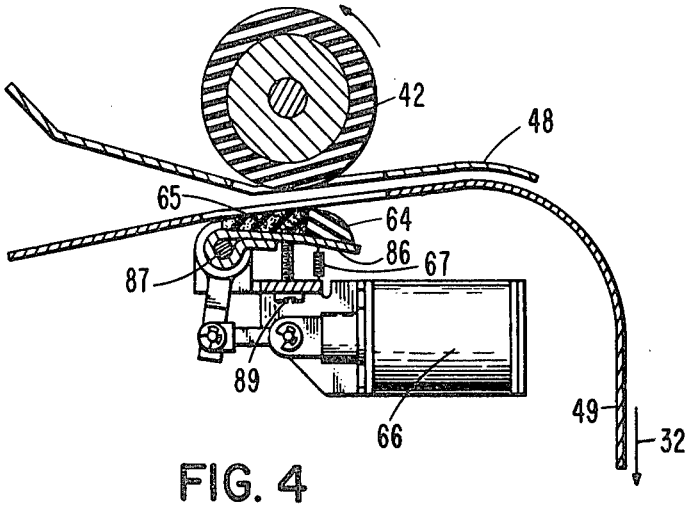
FIG. 4 is a view showing the nip closing member for FIG. 2's duplex bin.

Combing wheel 41 is operable to feed the top sheet of the stack such that the leading edge portion of this top sheet is staged within the normally open sheet drive nip formed by friction feed roller 42 and an underlying pivoted pressure pad 64–65, shown in FIG. 4. Pad 64 is a relatively hard, low friction material, for example polycarbonate. The coefficient of friction of feed roller 42 is selected to be higher than that of pad 64, such that a single sheet of paper within the nip 64–42, will be fed in a forward direction (to the right as shown in FIG. 4) under the driving action of roller 42.

Pad 64 is supported by a metallic ramp-like member which is connected to the armature of solenoid 66, this solenoid being controlled in a well known manner by the copier's logic, to be energized, and thus feed a sheet to the copier's transfer station, upon copier logic command.

Also seen in FIG. 4, an opening is formed in lower sheet guide 49, to accommodate upward movement of pad 64–65. Spring 67 biases pad 64–65 to its retracted position, out of this opening.

As is well known in the art of combing wheel sheet feeders, the leading edge of a number of the stack's top sheets will be staged forward in shingled fashion, and in the sheet feeding direction, for a distance encompassed by the open nip 42–64, and an up-stream located resilient sponge rubber pad 65. The shingled attitude of perhaps the stack's top five sheets is such that the leading edge portion of the one top sheet is positioned in nip 42–64, whereas the remaining four underlying sheets have their leading edges staged in shingled fashion in the zone encompassed by soft sponge rubber pad 65. As the top sheet is fed away to the right, by operation of roller 42, the friction between this top sheet and the second sheet may be such that the leading edge of the second sheet moves into sponge rubber pad 65, and is retained therein so as not to feed with the top sheet.

When pad 64 is in its nip-open position, it is retracted out of the sheet-shingling plane defined by sheet guide 49. Thus, the pad cannot disturb the shingling action to be achieved by its combing wheel 41, as the leading edges of these sheets are supported by, and slide freely on, sheet guide 49.

FIG. 5 shows more clearly the dimensions of pad 64. By way of example, pad 64 is 1.10 inches wide, measured in a direction parallel to the feed roller's axis 68 (FIG. 2).

FIG. 6 also shows the blowing air jet member 69 of a pneumatic sheet sensor couple 69, 70. As seen in FIG. 6, air issuing upward through space 71 enters member 70 to increase the pressure in pneumatic-to-electric transducer 72. The presence or absence of a sheet in space 71, i.e. the leading edge of the stack's top sheet, operates to control an electrical switching circuit whose output comprises terminals 73 and 74. These terminals are connected to a power supply (not shown) to effect energization of solenoid 46 (FIG. 7), to thereby raise its associated combing wheel 41, when the presence of a sheet is detected in space 71.

By way of example, the combing wheel in duplex bin 36 engages the top sheet of the stack therein with a force of approximately 150 grams when 100 sheets reside in the duplex bin, and approximately 550 grams when one sheet is in the duplex bin, generically a range of from 100 to 600 grams is preferred. Too low a force produces slow shingling. Too high a force produces paper marking or damage.

While the location of the combing wheel on the sheet stack is not critical, it has been found to operate satisfactorily when it is located approximately two inches from the sheet's leading edge, and approximately four and one-half inches from its rear side edge; see FIG. 8. The four and one-half inch dimension is selected to insure that the combing wheel is located to the rear (i.e. the copier's back wall) of the center of the shortest paper to be fed. Thus, operation of the combing wheel tends to rotate the sheet slightly in a clockwise direction (viewed from above), to thereby move its leading edge rear corner 83 outward away from mechanisms which might obstruct sheet feed.

This slight rotation has the effect of moving the sheet's trailing edge corner 84 back toward the bin's rear wall. Thus, it is desirable to provide, in all three bins 23, 24 and 36, a means such as 55 (FIG. 2) to overhang at least this trailing edge corner, to prevent this corner of the shingled sheets from climbing up the rear side of the bin.

Figure 9:
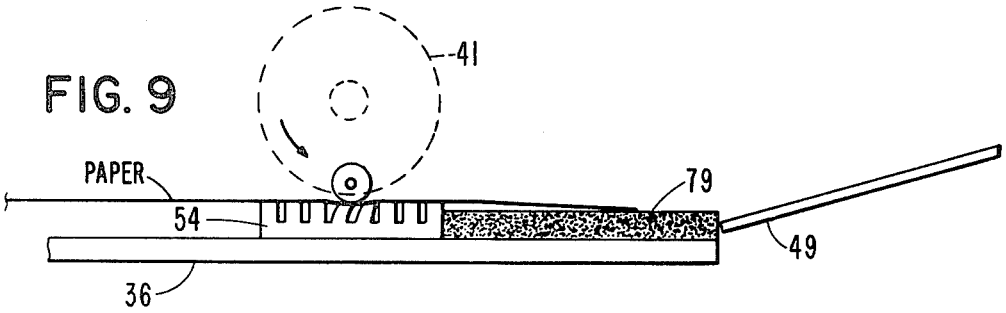
FIG. 9 is a side view of the portion of the duplex bin which includes the bin's bottom-of-the-bin pad.

As shown in FIG. 9, pad 54 is fixed to the bottom of duplex bin 36 and its upper surface resides at a higher elevation than the upper surface of a foam rubber pad 79. When combing wheel 41 is forcibly lowered onto the paper sheets then resident in duplex bin 36, rotation of combing wheel 41 causes the corrugations in the upper surface of rubber pad 54 to deform in the direction of sheet feed. Generically, resilient pad 54 is movable in the direction of sheet shingling, so as to simulate the presence of a sheet underlying the bottommost sheet in duplex bin 36, thereby enabling combing wheel 41 to reliably shingle the stack's bottom sheets to drive roller 42.

Bins 23 and 24 are provided with a similar pad. By way of example, pad 54 is formed of solid rubber, of durometer 80 to 90, is 0.12 inch thick, 0.66 inch long (measured in the direction of paper feed), and 0.40 inch wide. The cuts therein, which form the ribs, are 0.015 inch wide and 0.070 inch deep.

Figure 10:
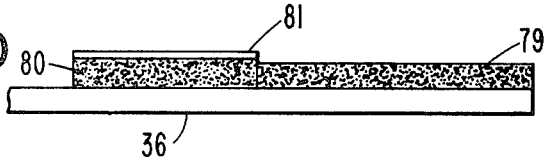
FIG. 10 is a side view of an alternate bottom-of-the-bin pad.
Figure 11:
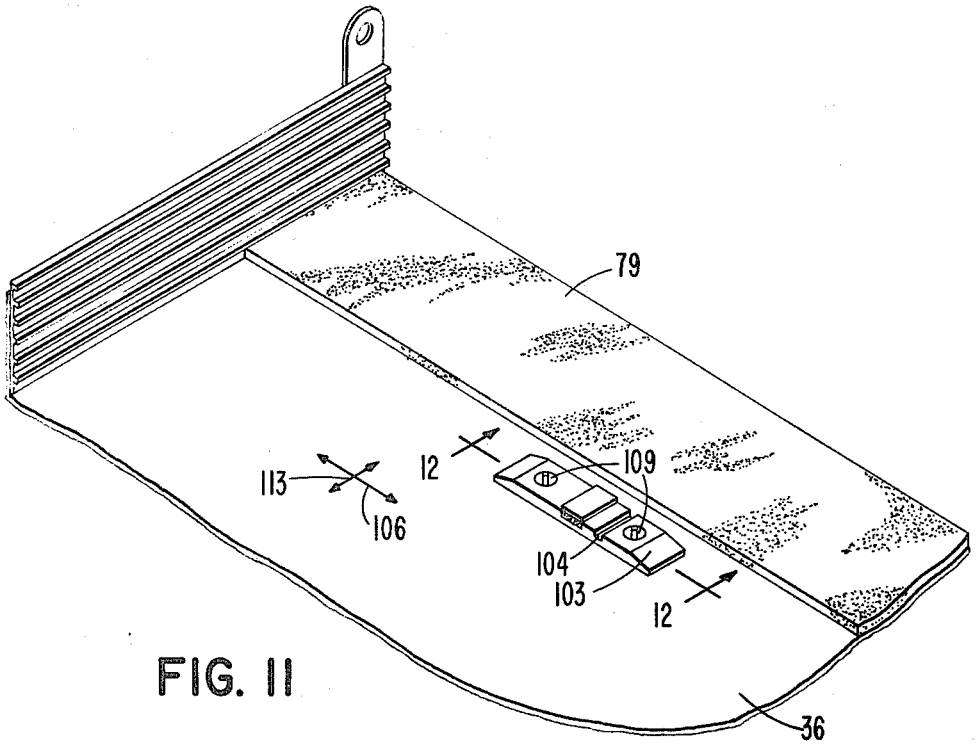
FIG. 11 is a partial view of FIG. 2's duplex bin.

FIG. 10 shows an alternative structure for FIG. 2's bottom-of-the-bin pad. In the FIG. 10 construction, resilient pad 80 takes the form of foam rubber, whose upper surface is covered by a thin film of low friction material 81, for example, PTFE film. As noted herein, the combing wheel for duplex bin 36 engages the paper therein with increasing force as the number of sheets in the bin decreases. It has been found that the bottom-of-the-bin pad of FIG. 10 reliably accommodates this varying force.

As shown in FIG. 8, combing wheel 41 is situated forward of, and to the rear of, the center of gravity of the smallest sheet 82 which may reside in duplex tray 36. As a result of this construction and arrangement, the sheet tends to rotate slightly in a clockwise direction, as seen in the top view of FIG. 8, thus causing the sheet's forward corner 83 to pull away from the duplex tray's back wall 51, while the sheet's rear corner 84 tends to be forced into the rear wall. The function of FIG. 2's tongues, projections or ribs 55 is to prevent the sheet's rear corner 84 from climbing up the surface of wall 51, as sheet 82 and its underlying sheets (if any) are shingled forward by operation of combing wheel 41.

Bins 23 and 24 of FIG. 1 are constructed and arranged to include a similar overhanging rib to that of duplex bins member 55, to perform a similar function as the top sheets resident in bins 23 and 24 are shingled forward by operation of their corresponding combing wheel 41.

As seen in FIGS. 2 and 7, the duplex bin's combing wheel assembly includes a flange 75 by which the assembly is mounted to the copier's frame member 40. Solenoid 46 is mounted to flange 75. Spring 85 force biases the duplex bin's combing wheel 41 off the paper therein. Energization of solenoid 46 draws link 47 down, forcing the combing wheel onto the paper in the duplex tray.

FIG. 4 discloses the nip closing member for FIG. 2's duplex bin, i.e. the movable composite pad underlying the duplex bin's feed roller 42. This composite pad is mounted to a plastic plate 86 which is pivoted at fixed-position pivot 87. Pivot 87 is mounted to FIG. 2's feed roller frame 88, as are all nip closing components, including guides 48 and 49, and solenoid 66.

Plate 86 is spring biased, by spring 67, to abut adjustable stop 89. Solenoid 66 is energized by copier logic upon a need to feed a side-one-copied sheet out of FIG. 2's duplex bin 36 to FIG. 1's transfer station 17, for second-side-copying.

With reference to FIGS. 11–14, a preferred construction of the duplex bin's bottom-of-the-bin pad is disclosed. This pad is generally of the type shown in FIG. 14, wherein pad 100 comprises a bottom foam rubber portion 101, a middle layer of rubber tape 111 and an upper Teflon skin 102. Pad 100 is fixed to plastic member 103 (FIGS. 11 and 12), as by a gluing or sticking-tape layer 112. Member 103 includes a gage groove 104 which is usable with straight edge member 105 to facilitate initial location of member 103 relative fixed-position combing wheel 41. Member 103 is movable in the directions indicated by arrows 106 and 113.

Member 103 includes a lower boss 107 whose dimension in direction 106 is smaller than the similar dimension of a slot 108 formed in the bottom of the duplex bin. The long dimension of slot 108 extends parallel to the combing wheel's rotational axis, i.e. shaft 56 of FIG. 2. In a similar fashion as small adjustment of member 103 in the direction of arrow 113 is provided to compensate for tolerances, but does not control skew.

Figure 12:
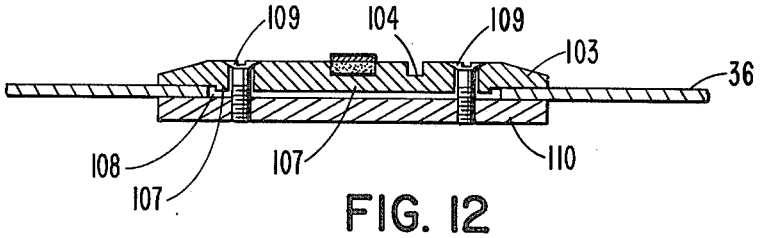
FIG. 12 is a cross-sectional view of FIG. 11's bottom-of-the-bin pad.
Figure 14:
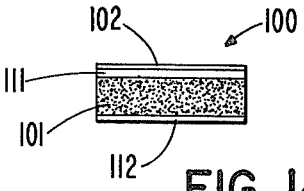
FIG. 14 is an enlarged view of the duplex bin's bottom-of-the-bin pad.

Boss 107 is thinner than the duplex bin's lower surface, as seen in FIG. 12; thus, tightening of bolts 109 causes the bin's lower surface to be frictionally engaged by member 103's end portions and metallic member 110.

Initially, during manufacture, bolts 109 are loosely engaged. Thereafter, member 103 is centrally positioned on the crowned rollers of combing wheel 41 by the use of member 105 and groove 104. Bolts 109 are then tightened.

As will be appreciated by those skilled in the art, mass production of an automatic duplexing copier produces variable stacking of side-one copied sheets in the duplex bin. For the majority of these manufacturing tolerance variable copies, this central location of the duplex bin's bottom-of-the-bin pad may produce reliable out-feed for side-two copying.

However, a manufacturing procedure is to observe out-feed, as from the top of the duplex bin, as seen in FIG. 8.

Figure 13:
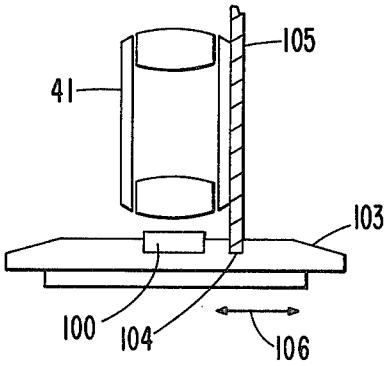
FIG. 13 is a view showing initial adjustment of the bottom-of-the-bin pad, looking in the direction of sheet shingling, i.e. toward the open feed nip.

If the sheet's leading corner 83 occasionally tends to catch as the sheet traverses FIG. 1's path 32 pad, i.e. the sheet is not moving far enough away from surface 51 during out-feed, the pad is adjusted to the left, along 106 of FIG. 13, i.e. to the rear of the copier of FIG. 1. If the entire sheet edge 83–84 moves too far away from surface 51, such that later alignment at sheet path 28 becomes unreliable, the pad is adjusted to the right, along 106 of FIG. 13, i.e. to the front of the copier of FIG. 1.

While the invention has been particularly shown and described with reference to a preferred embodiment thereof, it will be understood by those skilled in the art that various changes in form and details may be made therein without departing from the spirit and scope of the invention.

What is claimed is:

1. A sheet fed printing device capable of selectively operating in a simplex or a duplex copy mode, having at least one paper supply drawer and a duplex bin wherein side-one printed sheets are stored prior to side-two printing, and having means operable to control the serial feeding of sheets from said duplex bin to a printing station, said duplex bin comprising:

a fixed position, substantially horizontal surface member adapted to support side-one copied sheets;

a movable mounted combing wheel overhanging said surface member so as to cooperate with the top sheet of paper in the duplex bin, said combing wheel normally being raised from said surface member to facilitate the automatic depositing of side-one printed sheets in said duplex bin, said combing wheel comprising a rotatable support member rotatable about an axis and carrying a series of independently rotatable rollers at its periphery;

combing wheel control means operable to control movement of said combing wheel to shingling engagement with the top sheet in said duplex bin;

a resilient pad mounted on said surface member below said combing wheel, said resilient pad being movable in the direction of combing wheel movement so as to enhance shingling of the bottom several sheets in said duplex bin; and means facilitating adjustment of said pad generally parallel to said axis so as to control the direction of shingling of said bottom several sheets by said combing wheel.

2. The device of claim 1 wherein said pad includes gage means facilitating initial positioning of said pad relative to said combing wheel.

3. Combing wheel sheet feeding means operable to feed the top sheet of a stack of sheets supported by a platform, comprising:

a combing wheel rotatable about an axis and having a plurality of crowned individual rollers cooperating with the top sheet of the stack;

a resilient pad mounted on said platform under said combing wheel and movable in the direction of sheet shingling, so as to simulate the presence of sheets and thereby enable said combing wheel to reliably shingle the stack's opposite boundary sheets; and means facilitating manual adjustment of said pad generally parallel to said axis to thereby control the degree of cooperation between said pad and the crown of said rollers, and to thereby control the direction of sheet shingling.

4. The sheet feeding means defined by claim 3 wherein said pad includes gage means facilitating initial positioning of said pad relative to said combing wheel.

5. The sheet feeding means defined by claim 4 wherein said combing wheel is selectively movable toward shingling engagement or away from shingling engagement with the top sheet of the stack.

6. An electrophotographic copying device capable of duplex copying, wherein one or more individual sheets of side-one copies are automatically deposited in a duplex bin prior to side-two copying, including:

a duplex bin having surface against which the side-one copy sheets are pressed during feed-out for side-two copying;

a combing wheel sheet feeder force biased to press the side-one copy sheets against said bin surface during feed-out for side-two copying, said combing wheel comprising a rotatable support member rotatable about an axis and carrying a series of sheet-engaging, independently rotatable rollers at its periphery;

bottom-of-the-bin means movable by operation of said combing wheel in the direction of said feed-out, to thus simulate a nonexistent last sheet on said surface; and means facilitating adjustment of said bottom-of-the-bin means in a direction generally parallel to said axis to thus control the direction of sheet feed-out.

7. The device of claim 6 wherein said combing wheel is force biased away from the side-one copy sheets during automatic in-feed of these sheets to said duplex bin.

8. The device of claim 7 wherein the duplex bin's surface is generally horizontal, and said bottom-of-the-bin means is movable in the direction of said feed-out by virtue of a resilient construction.

9. The device of claim 8 wherein said combing wheel rotates in a plane generally normal to the surface of side-one copy sheets.

* * * * *